US009923302B2

(12) United States Patent
Friesen

(10) Patent No.: US 9,923,302 B2
(45) Date of Patent: Mar. 20, 2018

(54) PLUG CONNECTOR HAVING A PLUGGING POSITIONING MEANS

(71) Applicant: HARTING ELECTRONICS GMBH, Espelkamp (DE)

(72) Inventor: Heinrich Friesen, Minden (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 15/535,668

(22) PCT Filed: Feb. 1, 2016

(86) PCT No.: PCT/DE2016/100040
§ 371 (c)(1),
(2) Date: Jun. 13, 2017

(87) PCT Pub. No.: WO2016/138890
PCT Pub. Date: Sep. 9, 2016

(65) Prior Publication Data

US 2017/0358889 A1 Dec. 14, 2017

(30) Foreign Application Priority Data

Mar. 4, 2015 (DE) ..... 10 2015 103 135

(51) Int. Cl.
*H01R 13/627* (2006.01)
*H01R 13/52* (2006.01)
(Continued)

(52) U.S. Cl.
CPC ..... *H01R 13/6277* (2013.01); *H01R 13/5202* (2013.01); *H01R 13/5219* (2013.01);
(Continued)

(58) Field of Classification Search
CPC ..... H01R 13/6275; H01R 13/6277; H01R 13/639; H01R 13/62; H01R 24/40
See application file for complete search history.

(56) References Cited

U.S. PATENT DOCUMENTS 4,902,045 A 2/1990 McGugan et al. ..... F16D 1/10
7,625,227 B1 12/2009 Henderson et al. . H01R 13/627
(Continued)

FOREIGN PATENT DOCUMENTS

CN 203386951 1/2014 ..... H01R 13/40
DE 10117738 10/2002 ..... H01R 13/627
(Continued)

OTHER PUBLICATIONS

German Office Action issued in corresponding German Application Serial No. 102015103135.3 dated Oct. 28, 2015 (6 pages).
(Continued)

*Primary Examiner* — Xuong Chung Trans
(74) *Attorney, Agent, or Firm* — Hayes Soloway P.C.

(57) ABSTRACT

A plug connector has a cylindrical housing body having at least one step, which forms two different regions each having different housing diameters, wherein the region having the smaller diameter is designed as a plug-in region and the region having the larger diameter is designed as a socket region, wherein the plug connector has a lock, which is captively connected to the housing body, wherein the plug connector has an actuator, which is operatively connected to the lock, wherein the plug connector has a plugging positioner, which at least partially surrounds the plug-in region. An attachment flange fits the plug connector and has an insertion region designed as a hollow cylinder, wherein the inner region of the hollow cylinder has at least one step,
(Continued)

which forms two different regions each having different inside diameters, wherein the inner region of the insertion region is unthreaded.

3 Claims, 3 Drawing Sheets

(51) Int. Cl.
*H01R 13/639* (2006.01)
*H01R 24/40* (2011.01)
*H01R 103/00* (2006.01)
*H01R 13/62* (2006.01)

(52) U.S. Cl.
CPC ..... *H01R 13/6275* (2013.01); *H01R 13/639* (2013.01); *H01R 24/40* (2013.01); *H01R 13/62* (2013.01); *H01R 2103/00* (2013.01)

(56) References Cited

U.S. PATENT DOCUMENTS

| | | | | |
|---|---|---|---|---|
| 9,039,434 | B2 * | 5/2015 | Winningham ..... | H01R 13/521 439/271 |
| 9,425,548 | B2 * | 8/2016 | Van Swearingen .. | H04B 5/0012 |
| 9,478,911 | B2 * | 10/2016 | Friesen ..... | H01R 13/639 |
| 9,692,174 | B1 * | 6/2017 | Yu ..... | H01R 13/622 |
| 2003/0190834 | A1 | 10/2003 | Barlian et al. ..... | H01R 13/627 |
| 2009/0269981 | A1 * | 10/2009 | Haruna ..... | H01R 9/037 439/607.04 |
| 2009/0275226 | A1 | 11/2009 | Chen ..... | H01R 13/52 |
| 2015/0303620 | A1 | 10/2015 | Friesen ..... | H01R 13/639 |
| 2016/0126673 | A1 | 5/2016 | Friesen ..... | H01R 13/639 |

FOREIGN PATENT DOCUMENTS

| | | | |
|---|---|---|---|
| DE | 102012100615 | 7/2013 | ..... G02B 6/36 |
| DE | 102012111408 | 10/2013 | ..... H01R 13/639 |
| DE | 102014105144 | 10/2015 | ..... H01R 13/52 |
| WO | WO2015007268 | 1/2015 | ..... H01R 13/627 |

OTHER PUBLICATIONS

International Search Report issued in corresponding PCT Application Serial No. PCT/DE2016/100040 dated May 12, 2016 with English translation (5 pages).

Written Opinion of the International Search Authority issued in corresponding PCT Application Serial No. PCT/DE2016/100040 (7 pages).

* cited by examiner

PLUG CONNECTOR HAVING A PLUGGING POSITIONING MEANS

BACKGROUND OF THE INVENTION

The present invention relates to plug connectors of the so-called push-pull locking mechanism type. The plug connectors are preferably then used if the intention is to plug and unplug the plug connector in a simple manner.

DISCUSSION OF THE PRIOR ART

DE 101 17 738 C1, DE 10 2012 100 615 A1 and U.S. Pat. No. 4,902,045 A disclose a so-called push-pull plug connector having plug positioning means that are formed on the housing body.

CN 2 03 386 951 U and DE 10 2014 105 144 A1 disclose push-pull plug connectors having separate plug positioning means.

WO 2015 007 268 A1 discloses a plug connector that comprises a push-pull locking mechanism. In the case of plug connectors of this type it is also possible for plugging connections to be performed incorrectly. The type of locking mechanism does not protect against the plug connector being plugged by way of example into a device socket having a screw connection. The latching arms of the push-pull locking mechanism can grip around an unsuitable cylindrical device socket having an inner thread and can even provide a false impression that the locking connection has been performed correctly.

OBJECT OF THE INVENTION

The object of the invention is to propose a plug connector having a simplified push-pull locking mechanism with which it is possible to avoid plugging connections being performed incorrectly plugging.

SUMMARY OF THE INVENTION

The plug connector in accordance with the invention is embodied essentially from a cylindrical housing body. The housing body comprises at least one step that forms two different regions having different housing diameters. The region having the smaller diameter defines the so-called plugging region. The plugging region is a region that is plugged into a socket or a mounting flange of a device. The region having the larger diameter forms a so-called base region. By way of example, the locking device of the plug connector is fixed to the base region.

The plug connector comprises a locking means that is connected in a loss-proof manner to the housing body. Moreover, the plug connector comprises an actuating means that is operatively connected to the locking means. The term "operatively connected" in this case is understood to mean that the locking means can be mechanically moved by means of actuating the actuating means so that by way of example the plug connector is unlocked from a mounting flange and the plug connector can be pulled out.

The plug connector comprises a plug positioning means that at least in part comprises the above-mentioned plugging region of the housing body. The plug positioning means ensures a plug connection that protects against media such as dust and water. Moreover, the plug positioning means prevents the plug connector from being plugged in incorrectly. The function of the plug positioning means is explained more precisely below.

It is preferred that the locking means is fixed to the base region of the housing body with the aid of a resilient ring.

In an advantageous embodiment of the invention, the plug positioning means comprises two circumferential grooves, wherein one groove is oriented inwards, in other words towards the plugging region, and one groove is oriented outwards. In each case a sealing ring is arranged in the grooves. The plug connector ensures in the plugged state a particularly effective sealing arrangement with respect to media by virtue of this combination of circumferential grooves and sealing rings that are located in said grooves.

In an advantageous embodiment of the invention, the plug positioning means comprises three circumferential grooves, wherein two grooves are oriented inwards, in other words towards the plugging region, and one groove is oriented outwards. In each case a sealing ring is arranged in the grooves. The plug connector ensures in the plugged state a particularly effective sealing arrangement with respect to media by virtue of this combination of circumferential grooves and sealing rings that are located in said grooves.

The locking means advantageously comprises at least one locking arm that is oriented parallel with respect to the plugging region. However, the locking arm does not make physical contact with the connecting region. A latching hook is formed on the end of the at least one locking arm, said latching hook being used so as to reversibly contact the plug connector to a mounting flange and/or a mating plug connector.

The plug connector preferably comprises multiple locking arms that are oriented in a circumferential manner and parallel with respect to the plugging region.

In a particularly preferred embodiment, the plug positioning means is arranged between the locking means and the plugging region.

The mounting flange in accordance with the invention comprises a hollow cylinder. The inner region of the hollow cylinder comprises at least one step that forms two different regions having different inner diameters. The region having the larger diameter forms the so-called insertion region. The insertion region is configured as threadless. You could also say that the inner region of the hollow cylinder when viewed opposite the plugging direction is configured as threadless until the step. As a consequence, it is possible to rapidly and in a simple manner insert a plug connector.

BRIEF DESCRIPTION OF THE DRAWINGS

An exemplary embodiment of the invention is illustrated in the drawings and is further explained hereinunder. In the drawings.

The figures include partially simplified, schematic illustrations. In part identical reference numerals are used for identical elements, but where appropriate also for non-identical elements. Various views of the same elements could be scaled differently.

DETAILED DESCRIPTION OF THE DRAWINGS

Figure 1:
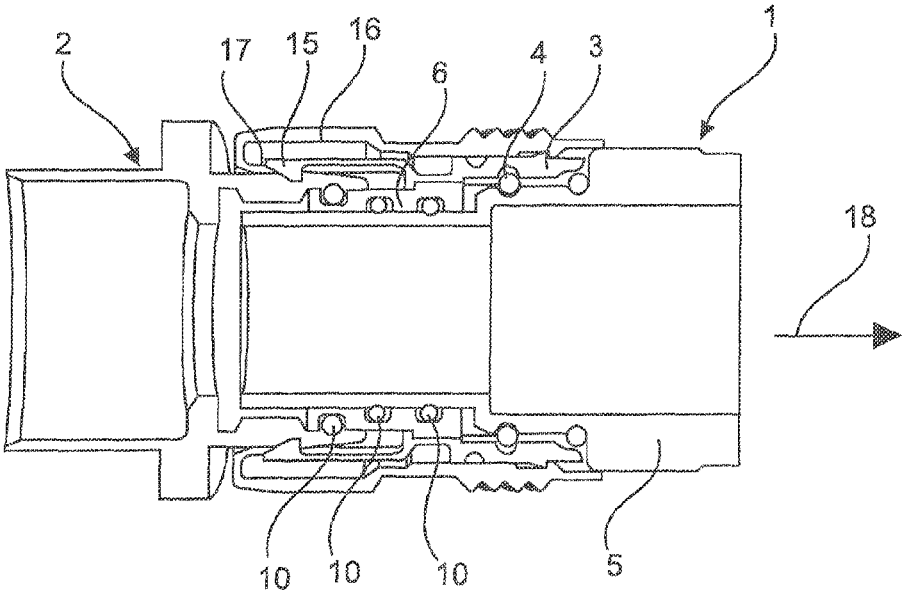
FIG. 1 illustrates a sectional view of a system comprising a mounting flange and a plug connector.

FIG. 1 illustrates a sectional view of a system in accordance with the invention of a plug connector 1 that is plugged in a mounting flange 2. The mounting flange 2 is generally integrated into a device (not illustrated).

The plug connector 1 comprises a locking means 3 that is fastened by way of a resilient ring 4 on the housing body 5 of the plug connector 1. Moreover, the plug connector 1 comprises a plug positioning means 6 that is arranged between the housing body 5 and the locking means 3.

The plug positioning means 6 includes three circumferential grooves, wherein two grooves 7, 8 are arranged on the interior or are oriented inwards and one groove 9 is oriented outwards. Sealing rings 10 are arranged in the respective grooves. The sealing rings 10 in the inner grooves 7, 8 seal the plug connector 1 itself. The sealing ring 10 that is located in the outer groove 9 seals the system of mounting flange 2 and plug connector 1 in the plugged state.

The diameter of the plugging region 11 of the housing body 5 is enlarged using the plug positioning means 6 in such a manner that it is no longer possible to plug the plug connector 1 incorrectly into a mounting flange having an insertion region having an inner thread.

Figure 2:
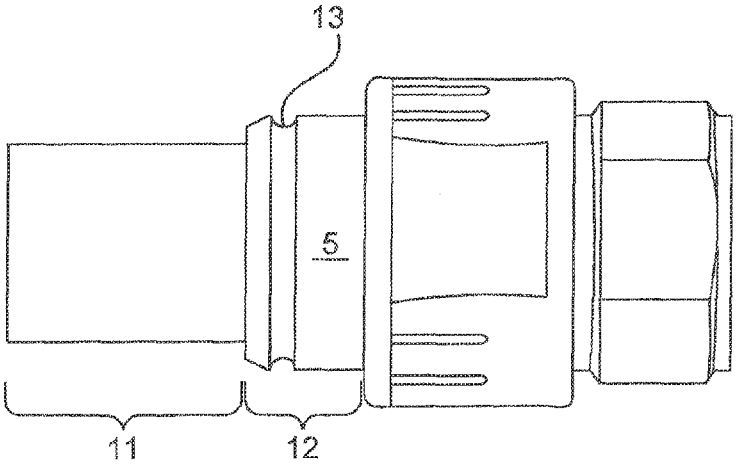
FIG. 2 illustrates a side view of a housing body of the plug connector.

FIG. 2 illustrates the essentially cylindrical housing body 5 of the plug connector 1. A step forms two different regions 11, 12 in the front part, said regions having different diameters.

The region having the smaller diameter forms the plugging region 11. The plugging region 11 is at least partially inserted so as to plug into the mounting flange 2. The region having the larger diameter is referred to as the base region 12. The base region 12 comprises a circumferential groove 13 and the resilient ring 4 for fixing the locking means 3 is embedded in said circumferential groove. By way of example, electrical contact elements (not illustrated) are arranged in the housing body 5 and said electrical contact elements are connected to individual conductors (not illustrated) of a multicore cable (not illustrated).

Figure 3:
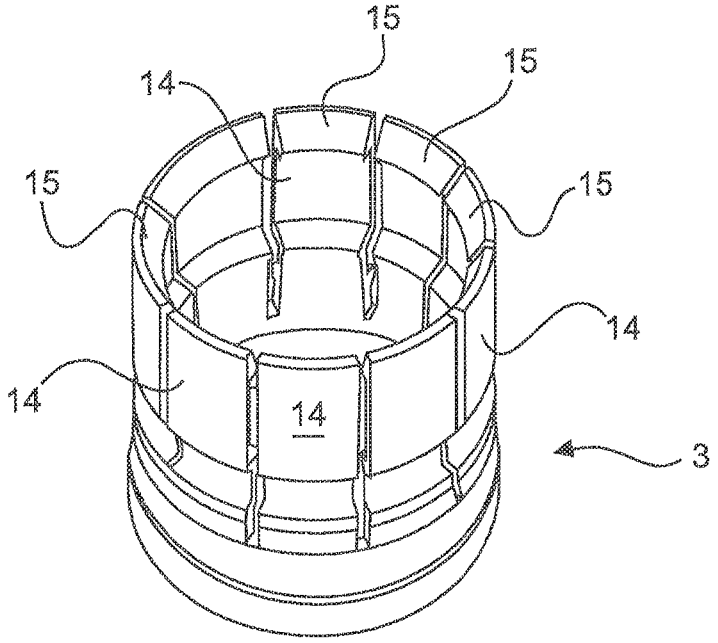
FIG. 3 illustrates a perspective view of a locking means of the plug connector.
Figure 4:
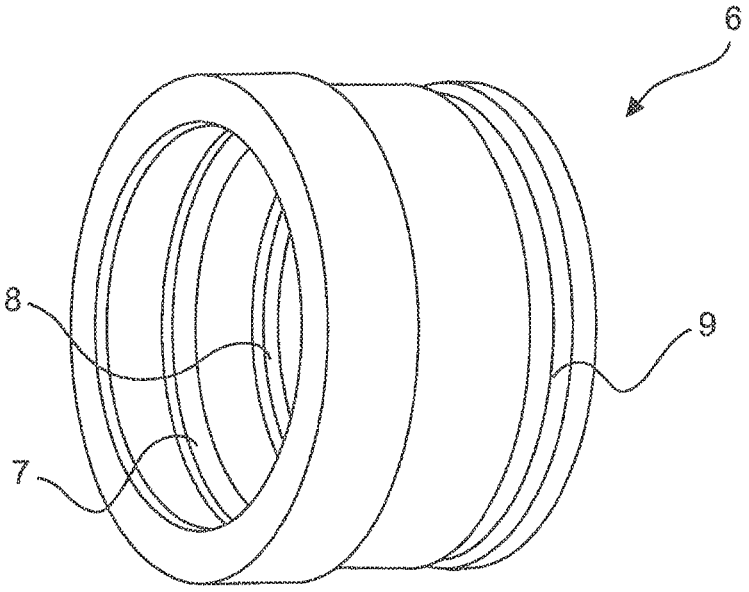
FIG. 4 illustrates a perspective view of a positioning means of the plug connector.

FIG. 3 illustrates the locking means 3. The locking means 3 is embodied essentially from a hollow cylinder and axial slots that form locking arms 14 are integrated into said hollow cylinder. Latching hooks 15 that are oriented inwards are arranged on the ends of the locking arms 14.

Figure 5:
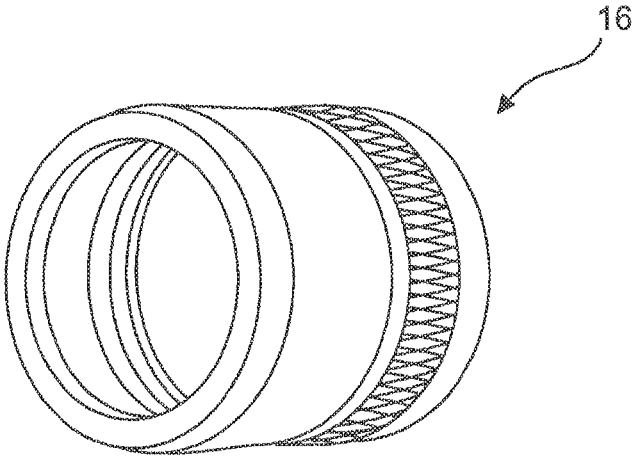
FIG. 5 illustrates a perspective view of an actuating means of the plug connector and FIG. 6 illustrates a perspective view of the mounting flange.

FIG. 5 illustrates a perspective view of the actuating means 16. The actuating means 16 comprises the base region 11 and the plugging region 12 of the housing body 5 and is in operative contact with the locking means 3. The actuating means 16 is configured essentially as a hollow cylinder. On one side, the edge of the hollow cylinder is turned over, as a result of which a collar is formed that is oriented into the interior of the hollow cylinder. The free collar end 17 acts upon inclined flank of the latching hook 15 when pulling back the actuating means 16 in the direction of the arrow 18 and presses the locking arms as a consequence radially outwards. The latching hooks 15 are removed from a groove 19 that extends around the mounting flange so that the plug connector 1 can be pulled out of the mounting flange 2. When plugging the plug connector 1 into the mounting flange 2, the latching hooks 15 initially slide along on the hollow cylinder 20 of the mounting flange before said latching hooks latch into the groove 19.

Figure 6:
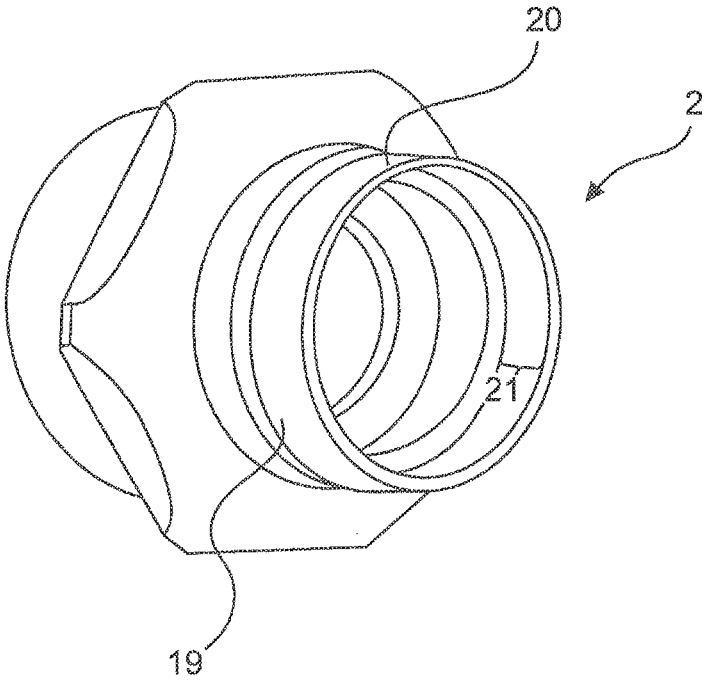

FIG. 6 illustrates a perspective view of the mounting flange 2. The mounting flange forms a hollow cylinder 20. The hollow cylinder comprises on the outside a groove 19 and, as mentioned above, latching hooks 15 of the locking arms 14 can engage in said groove. A step is illustrated in the inner region of the hollow cylinder 20, said step forming regions having a different diameter. The region having the larger diameter forms the so-called insertion region 21. The insertion region 21 is configured as threadless while the region that extends further downwards having the smaller diameter comprises a thread (not illustrated).

The invention relates to a plug connector (1) that is embodied from a cylindrical housing body (5) that comprises at least one step that forms two different regions (11, 12) having different housing diameters, wherein the region having the smaller diameter is configured as a plugging region (11) and the region having the larger diameter is configured as a base region (12), wherein the plug connector (1) comprises a locking means (3) that is connected in a loss-proof manner to the housing body (5), wherein the plug connector (1) comprises an actuating means (16) that is operatively connected to the locking means (3), wherein the plug connector (1) comprises a plug positioning means (6) that at least in part comprises the plugging region (11).

The invention likewise relates to a mounting flange that matches the plug connector, said mounting flange comprising an insertion region (20) that is configured as a hollow cylinder, wherein the inner region of the hollow cylinder comprises at least one step that forms two different regions having different inner diameters, wherein the inner region of the insertion region (20) is configured as threadless.

LIST OF REFERENCE NUMERALS

1 Plug connector
2 Mounting flange
3 Locking means
4 Resilient ring
5 Housing body
6 Plug positioning means
7 Groove
8 Groove
9 Groove
10 Sealing ring
11 Plugging region
12 Base region
13 Groove
14 Locking arm
15 Latching hook
16 Actuating means
17 Free collar end
18 Arrow
19 Groove
20 Hollow cylinder
21 Insertion region

The invention claimed is:

1. A plug connector system comprising a mounting flange that comprises an insertion region that is configured as a hollow cylinder, wherein an inner region of the hollow cylinder comprises at least one step that forms two different regions having different inner diameters, wherein the region of the hollow cylinders having a larger diameter is configured as threadless, and a plug connector comprising:

a cylindrical housing body that includes at least one step that forms two different regions having different housing diameters, wherein a region of the plug connector having a smaller diameter forms a plugging region and a region of the plug connector having a larger diameter forms a base region, a lock connected to the housing body in a loss-proof manner, an actuator operatively connected to the lock, and a separate plug positioner that at least in part comprises the plugging region, wherein the plug positioner comprises three circumferential grooves, wherein two grooves are oriented inwards, towards the plugging region, and one groove is oriented outwards, a sealing ring is arranged in each of the grooves, the lock comprises at least one locking arm that is aligned parallel with respect to the plugging region, in which the locking arm makes no physical contact with said plugging region and a latching hook is formed on the end of the at least one locking arm and said latching hook is adapted to slide along an outer surface of the mounting flange to reversibly contact the plug connector to the mounting flange and/or a mating plug connector.

2. The plug connector system as claimed in claim 1, wherein the lock is fixed to the base region of the housing body by a resilient ring.

3. The plug connector system according to claim 1, wherein the plug positioner is arranged between the lock and the plugging region.

* * * * *